US007504998B2

(12) United States Patent
Choi et al.

(10) Patent No.: US 7,504,998 B2
(45) Date of Patent: Mar. 17, 2009

(54) PIFA AND RFID TAG USING THE SAME

(75) Inventors: Won-Kyu Choi, Gyeonggi-do (KR); Hae-Won Son, Daejeon (KR); Je-Hoon Yun, Daejeon (KR); Ji-Hoon Bae, Daejeon (KR); Cheol-Sig Pyo, Daejeon (KR); Jong-Suk Chae, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 304 days.

(21) Appl. No.: 11/297,687

(22) Filed: Dec. 7, 2005

(65) Prior Publication Data

US 2006/0145927 A1 Jul. 6, 2006

(30) Foreign Application Priority Data

Dec. 8, 2004 (KR) ..... 10-2004-0103081
Apr. 28, 2005 (KR) ..... 10-2005-0035741

(51) Int. Cl.
*H01Q 1/38* (2006.01)

(52) U.S. Cl. ..... 343/700 MS

(58) Field of Classification Search ..... 343/700 MS, 343/830, 846, 853, 909, 829
See application file for complete search history.

(56) References Cited

U.S. PATENT DOCUMENTS 4,903,033 A * 2/1990 Tsao et al. ..... 343/700 MS
5,455,954 A * 10/1995 Packer ..... 710/74
6,903,687 B1 * 6/2005 Fink et al. ..... 343/700 MS
6,995,712 B2 * 2/2006 Boyanov ..... 343/700 MS
2004/0090369 A1 * 5/2004 McCarrick ..... 343/700 MS

FOREIGN PATENT DOCUMENTS

KR 1020030017214 A 3/2003
KR 1020030061003 A 7/2003
KR 1020040051002 A 6/2004

* cited by examiner

*Primary Examiner*—Huedung Cao Mancuso
(74) *Attorney, Agent, or Firm*—Blakely, Sokoloff, Taylor & Zafman LLP

(57) ABSTRACT

Provided is a planar inverted-F antenna (PIFA) which has a Co-Planar Waveguide (CPW) feeding structure and can be attached to a metal surface, and an RFID tag using the same. The PIFA includes a radiation patch layer; a Co-Planar Waveguide (CPW) feeding layer; a feeding probe; and a short-circuit. The CPW feeding layer includes a feeding means and a ground surface. The feeding probe electrically connects the radiation patch layer and the feeding means and provides a Radio Frequency (RF) signal to be radiated to the radiation patch layer. The short-circuiting means short-circuits the radiation patch layer and the ground surface through the dielectric layer. The PIFA can be applied to a passive RFID tag. Impedance matching between the antenna and the RFID chip is possible. Also, the PIFA can easily control resonant frequency of the antenna and reactance.

24 Claims, 6 Drawing Sheets

PIFA AND RFID TAG USING THE SAME

FIELD OF THE INVENTION

The present invention relates to a planar inverted-F antenna (PIFA) and a Radio Frequency Identification (RFID) tag using the same; and, more particularly, to a PIFA which has a Co-Planar Waveguide (CPW) feeding structure and can be attached to a metal surface, and the RFID tag using the PIFA.

DESCRIPTION OF RELATED ART

Since a tag is attached to an object formed of diverse materials and shapes, differently from a reader of a passive Radio Frequency Identification (RFID), it is a basic design conception of a tag antenna to minimize deterioration of an antenna characteristic by an attachment material. In particular, when the tag antenna is attached to a metal material, it is necessary to pay attention to designing of an antenna since return loss and radiation pattern characteristics can be affected seriously. When a general dipole antenna is brought close to a metal object, an antenna using a metal object as a part of a radiation structure should be considered as a tag antenna with the metal object attached thereto since electromagnetic wave cannot be radiated by an electromagnetic image effect. Such antennas are represented by a microstrip patch antenna and a planar inverted-F antenna (PIFA).

Generally, it is easy to fabricate the microstrip patch antenna. The microstrip patch antenna has a merit that it is light-weight and thin. However, since the microstrip patch antenna has a size of half-wave in a resonant frequency, it is not proper to be used for the RFID tag. On the contrary, the PIFA has a size a half as large as the microstrip patch antenna by short-circuiting a part without an electric field with a conductive plate and has a structure matched to specific impedance by changing a position of a feeding point based on a short-circuit plate. Also, the PIFA has a size of a quarter wavelength in a resonant frequency. Therefore, the PIFA is small and can be attached to a metal object.

FIG. 1 is a perspective view of a typical conventional PIFA, suggested in an article by T. Kashiwa, N. Yoshida and I. Fukai, entitled, "Analysis of Radiation Characteristics of Planar Inverted-F Type Antenna on Conductive Body of Hand-held Transceiver by Spiral Network Method", *IEE Electronics Letters*, Vol. 25, No. 16, pp. 1,044-1,045, 3 Aug. 1989. As shown in the drawing, the conventional PIFA includes a ground surface 1, a radiate patch 2, a feeding block 3 and a short-circuit plate 4. The short-circuit plate 4 short-circuits the radiate patch 2 and the ground surface 1 and reduces the size of the radiatation patch 2 and the ground surface 1 by a half of the size of microstrip patch antenna. The PIFA feeds the feeding block 3 by using a coaxial line at a point that an antenna impedance becomes 50 Ω.

A field of the PIFA is radiated by current formed in the radiate patch 2 and the ground surface 1. The mechanism is the same as a radiation mechanism of the microstrip patch antenna.

However, since the PIFA suggested in the article cannot control the antenna impedance at a feeding point, there is a difficulty that a position of a feeding block should be changed when the feeding point, at which the antenna impedance becomes 50 Ω, is changed based on an environment change such as a change in the size of a metal object is changed. Also, since the PIFA suggested in the above article has a size of a quarter wavelength in the resonant frequency, there is a problem that the size of the antenna is a little larger. Also, the PIFA suggested in the article does not provide a function satisfying a service such as the RFID sufficiently.

A study for realizing a multi-band, a broadband and miniaturized PIFA by integrating a slot and a stub with the PIFA has been progressed. U.S. Pat. No. 6,741,214, "Planar Inverted-F Antenna PIFA Having a Slotted Radiating Element Providing Global Cellular and GPS-Bluetooth Frequency Response" is one example of the study. FIG. 2 is a perspective view showing a PIFA suggested in the U.S. Pat. No. 6,741,214.

In the conventional PIFA shown in FIG. 2, a C-type slot is formed in a radiate patch 16 to realize a dual resonant mode, and an impedance controlling stub 13 is connected perpendicularly to the radiate patch 16 to control capacitive reactance between the radiate patch 16 and the ground surface 11. Also, a short-circuit metal plate 12 short-circuits the radiate patch 16 from the ground surface 11. The metal structures 12, 13, 14 and 16 are produced by a metal plate, and they are covered with a dielectric material 17 to maintain physical stability.

However, since it is very difficult for the PIFA to diversely control the inductive reactance and the capacitive reactance with the impedance controlling stub, a feeding point for 50 Ω can be changed based on a usage environment. Also, there are problems that the bandwidth and radiation efficiency of the PIFA are reduced due to the dielectric material used for the mechanical stability and that it is difficult to use the PIFA for a RFID tag by attaching an RFID chip due to the PIFA. Also, when the PIFA is directly attached to the metal object, there is a problem that a resonant characteristic of the antenna can be changed based on the material and a shape of the metal surface.

SUMMARY OF THE INVENTION

It is, therefore, an object of the present invention to provide a planar inverted-F antenna (PIFA that can be miniaturized through a radiation patch layer having a U slot, and easily adapted to a Radio Frequency Identification (RFID) tag by a Coplanar Waveguide (CPW) feeding structure.

Also, it is another object of the present invention to provide the PIFA having characteristics that resonant frequency is controlled based on the number of a short-circuit posts and an interval among short-circuit posts, and reactance of the antenna can be controlled by the CPW feeding structure.

Also, the present invention provides the PIFA attachable to a metal surface for smooth communication between a tag and a reader.

Other objects and advantages of the invention will be understood by the following description and become more apparent from the embodiments in accordance with the present invention, which are set forth hereinafter. It will be also apparent that objects and advantages of the invention can be embodied easily by the means defined in claims and combinations thereof.

In accordance with an aspect of the present invention, there is provided a PIFA, including: a radiation patch layer which is formed on one side of a dielectric layer; a CPW feeding layer; a feeding probe; and a short-circuit. The CPW feeding layer includes a feeding means on the other side of the dielectric layer and a ground surface at a predetermined distance from the feeding means. The feeding probe electrically connects the radiation patch layer and the feeding means through the dielectric layer and provides a Radio Frequency (RF) signal to radiate to the radiation patch layer. The short-circuiting means short-circuits the radiation patch layer and the ground surface through the dielectric layer.

In accordance with another aspect of the present invention, there is provided a PIFA, including: a radiation patch layer which is formed on one side of a first dielectric layer; a CPW feeding layer; a feeding probe; a short-circuiting means. The CPW feeding layer comes into contact with the other side of the first dielectric layer, and includes the feeding means formed on one side of the second dielectric layer and the ground surface at a predetermined distance from the feeding means. The feeding probe electrically connects the radiation patch layer and the feeding means through the first dielectric layer and provides a RF signal to radiate to the radiation patch layer. The short-circuiting means short-circuits the radiation patch layer and the ground surface through the first dielectric layer.

BRIEF DESCRIPTION OF THE DRAWINGS

The above and other objects and features of the present invention will become apparent from the following description of the preferred embodiments given in conjunction with the accompanying drawings, in which.

DETAILED DESCRIPTION OF THE INVENTION

Other objects and advantages of the present invention will become apparent from the following description of the embodiments with reference to the accompanying drawings. Therefore, those skilled in the art that the present invention is included can embody the technological concept and scope of the invention easily. In addition, if it is considered that detailed description on the prior art may blur the points of the present invention, the detailed description will not be provided herein. The preferred embodiments of the present invention will be described in detail hereinafter with reference to the attached drawings.

Figure 1:
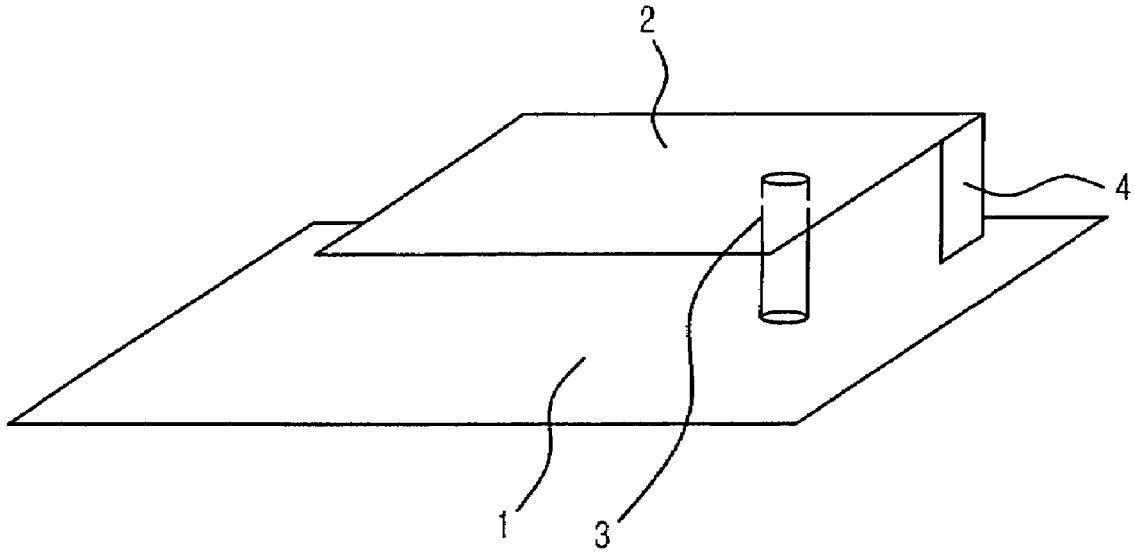
FIG. 1 (PRIOR ART)
FIG. 1 is a perspective view of a typical planar inverted-F antenna (PIFA)
Figure 2:
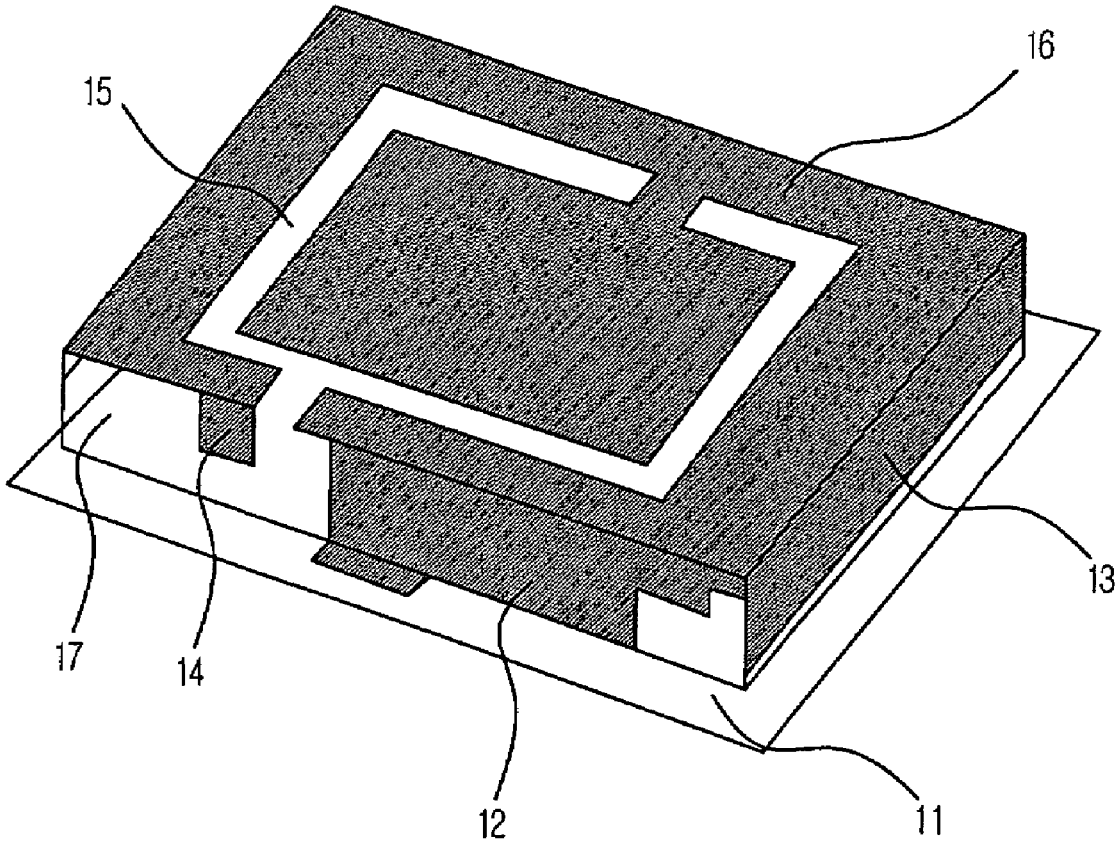
FIG. 2 (PRIOR ART)
FIG. 2 is a perspective view showing a conventional PIFA.
Figure 3:
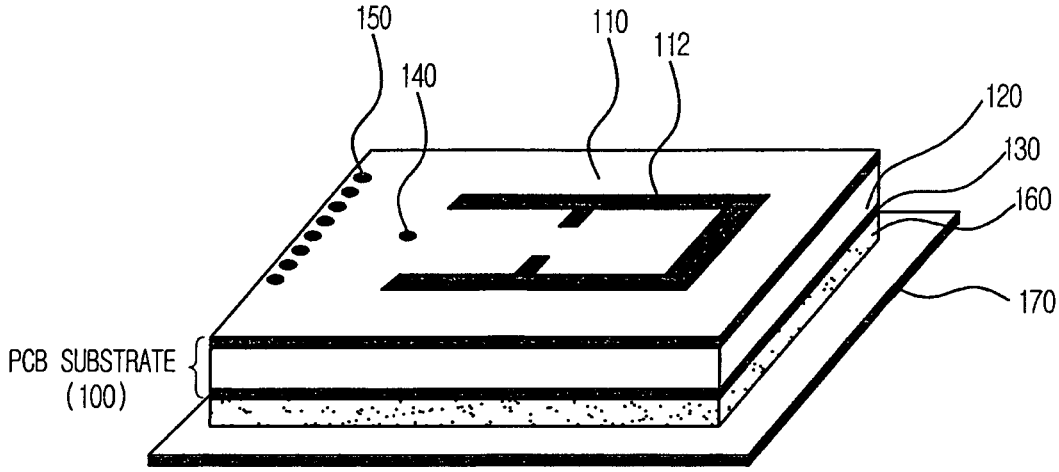
FIG. 3 is a perspective view showing a PIFA in accordance with a first embodiment of the present invention.
Figure 4:
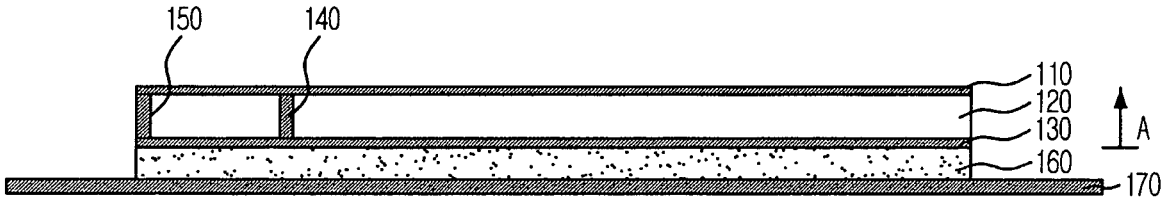
FIG. 4 is a cross-sectional view showing the PIFA of FIG. 3.

FIG. 3 is a perspective view showing a planar inverted-F antenna (PIFA) in accordance with a first embodiment of the present invention, and FIG. 4 is a cross-sectional view showing the PIPA of FIG. 3. The PIFA of the present invention includes a radiation patch layer 110, a dielectric layer 120, a Co-Planar Waveguide (CPW) feeding layer 130, a feeding probe 140 and a short-circuit post 150.

The radiation patch layer 110 is formed on one side of a Printed Circuit Board (PCB) substrate 100. The PCB substrate 100 has conductive layers on the upper and lower sides of the dielectric layer 120. The radiation patch layer 110 is formed by etching the conductive layers of the PCB substrate 100. The radiation patch layer 110 radiates a Radio Frequency (RF) signal provided from the feeding probe 140 based on resonance in a resonant frequency of an antenna and. A U-type slot 112 is formed on the radiation patch layer 110. When the U-type slot 112 is formed on the radiation patch layer 110, a small antenna can be realized by extension of a resonance length of the antenna. It is apparent to those skilled in the art that other types of slots except the U-type slot can be formed to realize the small antenna.

Stubs 114*a* and 114*b* for controlling current of the antenna are symmetrically formed in the U-type slot 112. The stubs 114*a* and 114*b* make the antenna small by minutely controlling the current of the antenna and lowering resonant frequency.

Figure 5:
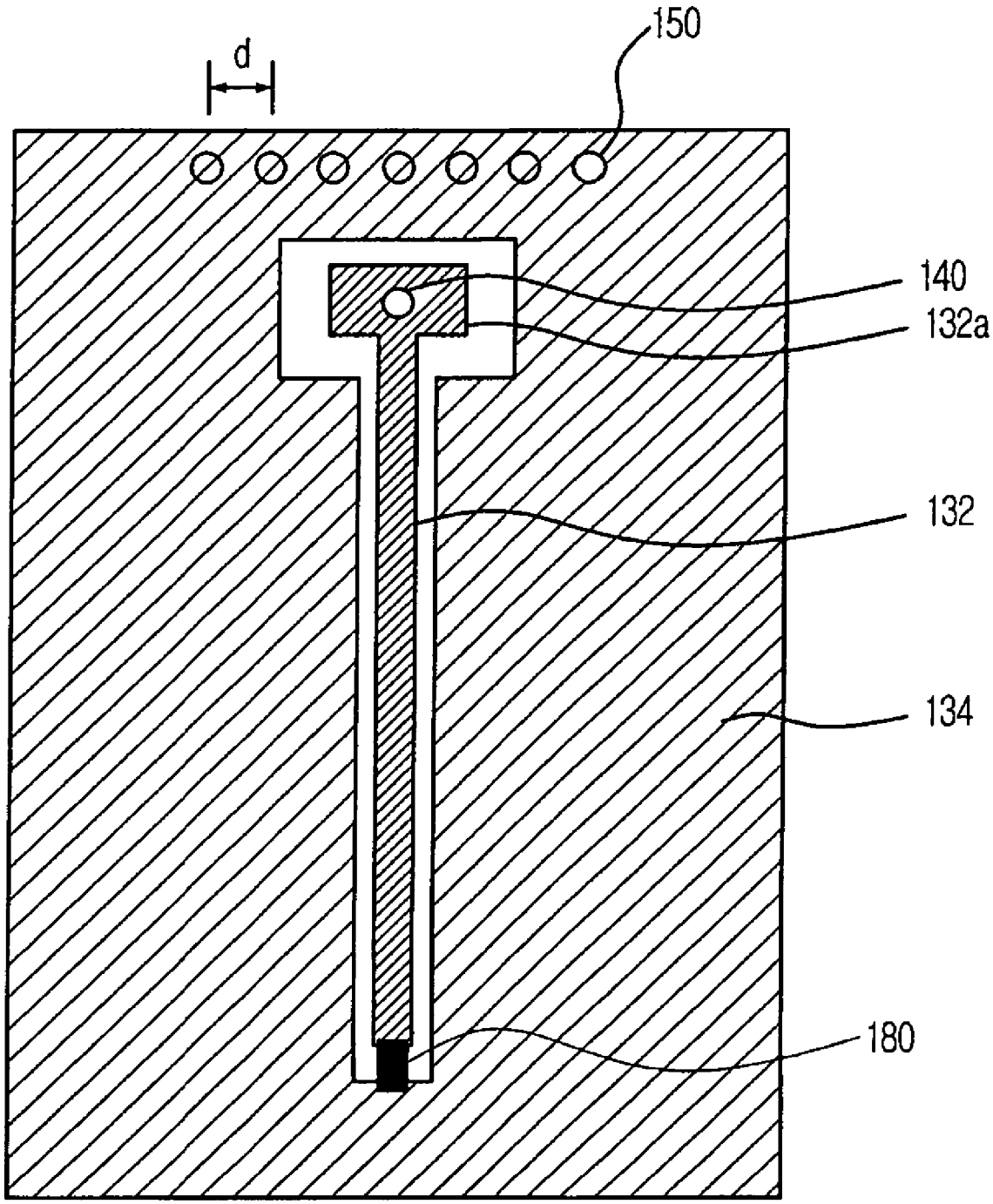
FIG. 5 is a bottom view of a Coplanar Waveguide (CPW) feeding layer shown FIG. 3.

The CPW feeding layer 130 is formed on the other side of the PCB substrate 100. The CPW feeding layer 130 is formed by etching a conductive layer of the PCB substrate 100 having a conductive layer on the upper and lower sides of the dielectric layer 120. As shown in FIG. 5, the CPW feeding layer 130 provides an RF signal to a Radio Frequency Identification (RFID) chip 180 and has a CPW structure. FIG. 5 is a bottom view of the CPW feeding layer 130 shown FIG. 3.

The CPW feeding layer 130 includes a feeding block 132 and a ground surface 134 formed on the same plane. A metal pad 132*a* is formed on one end of the inside of the feeding block 132, which has an entire structure of T shape. The feeding block 132 is covered with the ground surface 134, and is positioned at a predetermined distance from the feeding block 132. One terminal of the RFID chip 180 is connected to the feeding block 132 and the other terminal is connected to the ground surface 134. When the distance between the feeding block 132 and the ground surface 134 is controlled, characteristic impedance of the CPW feeding layer 130 is changed. The narrower the distance between the feeding block 132 and the ground surface 134 is, the larger characteristic impedance of the CPW feeding layer 130 is due to large capacitance between the feeding block 132 and the ground surface 134. On the contrary, the longer the distance between the feeding block 132 and the ground surface 134 is, the smaller characteristic impedance of the CPW feeding layer 130 is due to small the capacitance between the feeding block 132 and the ground surface 134.

The feeding probe 140 is connected to the metal pad 132*a* of the radiation patch layer 110 and the CPW feeding layer 130 through the dielectric layer 120. The position of the feeding probe 140 can be changed based on impedance of the antenna. The feeding probe 140 provides the RF signal to be radiated to the radiation patch layer 110 and electrically has an inductive reactance characteristic. However, inductive reactance and capacitive reactance should be the same and offset for resonation of an antenna. Accordingly, the feeding probe 140 controls capacitive reactance formed between the feeding probe 140 and the radiation patch layer 110 by controlling an area of the metal pad 132*a* formed on the feeding block 132. That is, when the dielectric layer 120 has a high dielectric rate, there is a problem that the capacitive reactance increases but bandwidth and radiation efficiency of the antenna decrease. However, when the metal pad 132*a* of the present invention is used, it is possible to prevent deterioration of the bandwidth and the radiation efficiency of the antenna since the capacitive reactance can increase although the dielectric layer 120 has a low dielectric rate.

Figure 6:
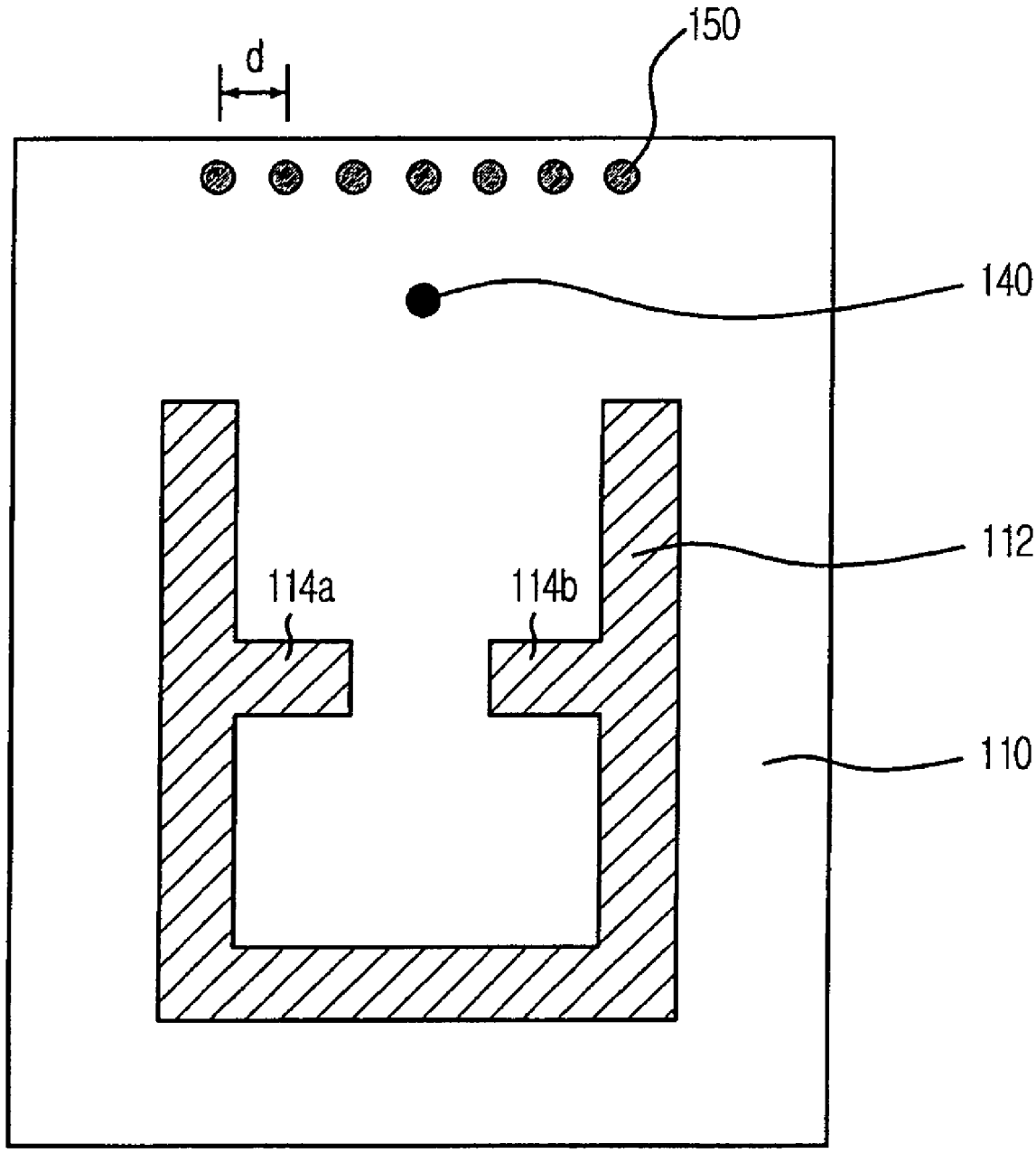
FIG. 6 is a diagram showing a radiation patch layer of the PIFA of FIG. 3.

The short-circuit post 150 is connected to the ground surface 134 of the radiation patch layer 110 and the CPW feeding layer 130 through the dielectric layer 120. FIG. 6 is a top view showing the radiation patch layer 110 of FIG. 3. As shown in FIG. 6, a plurality of short-circuit posts 150 are formed. When the number of the short-circuit posts 150 and the number of an interval (d) among the short-circuit posts are controlled, the resonant frequency of the PIFA can be changed. The larger the number of the short-circuit posts is, the higher the resonant frequency is, although the distance among the short-circuit posts becomes longer.

The spacing layer 160 electrically separates the PIFA of the present invention from the metal surface 170, to which the PIFA is attached. When the antenna is directly attached to the metal surface 170, it is preferred to separate the antenna and the attachment metal surface by forming the spacing layer 160 since the resonance characteristic of the antenna can be largely changed by a material and a formation of the metal surface. In particular, as shown in FIG. 5, when the RFID chip 180 is connected to the CPW feeding layer 130, the spacing layer 160 is required to prevent the RFID chip 180 from directly coming into contact with the metal surface 170. It is preferred to form the spacing layer 160 such as Styrofoam, of which a dielectric rate is similar to air in consideration of a characteristic of the antenna.

In case of the PCB substrate 100 having a conductive layer on both sides of the dielectric layer 120, a radiation pattern layer 110 is formed to have a U-type slot by etching the conductive layer of one side of the dielectric layer 120, and the CPW feeding layer 130 is formed on the conductive layer of the other side by performing etching to produce the RFID tag by using the PIFA of FIG. 3. Materials having a low dielectric rate such as Teflon can be used as the dielectric layer 120. As shown in FIG. 5, the CPW feeding layer 130 includes the feeding block 132 of the T shape having the metal pad 132*a* and the ground surface 134, which covers the feeding block 132 and is positioned at a predetermined distance from the feeding block 132.

The feeding probe 140 and the short-circuit post 150 are, respectively, connected to the metal pad 132*a* and the ground surface 134 by feeding a conductive material into a via hole formed in the PCB substrate 100. Subsequently, the RFID chip 180 is bonded on the CPW feeding layer 130 by using conductive ink. Since two signal lines, i.e., the feeding block 132 and the ground surface 134, are formed in flat on the dielectric layer 120, it is easy to bond the RFID chip 180 on the CPW feeding layer 130. Herein, since impedance toward an antenna in the RFID chip 180 is changed based on a bonding position of the RFID chip 180 on the CPW feeding layer 130, it is possible to control a degree of impedance matching between the antenna and the RFID chip 180 by changing the bonding position of the RFID chip 180. The RFID tag attachable to the metal surface 170 is produced by attaching the spacing layer 160 to the CPW feeding layer 130 by using Styrofoam.

It is apparent to those skilled in the art that the radiation patch layer and the CPW feeding layer can be formed by using deposition and printing methods on a dielectric object substrate instead of using the method of etching the PCB substrate.

Figure 7:
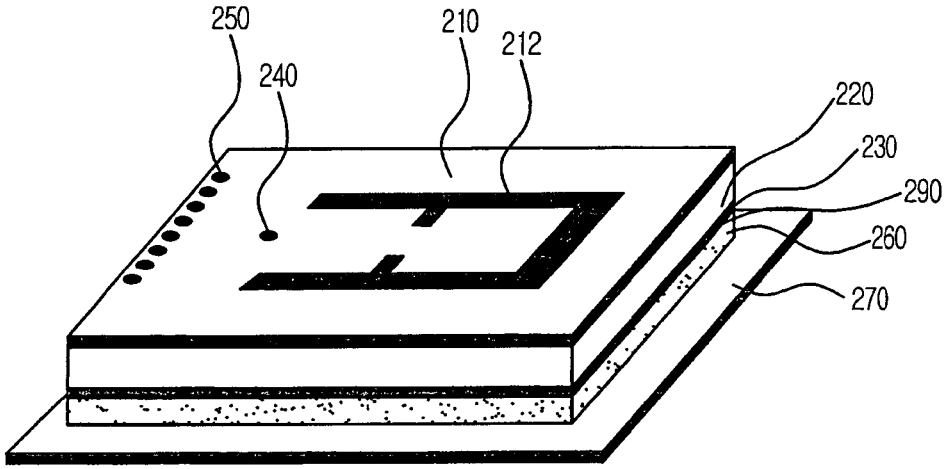
FIG. 7 is a perspective view of a PIFA in accordance with a second embodiment of the present invention.
Figure 8:
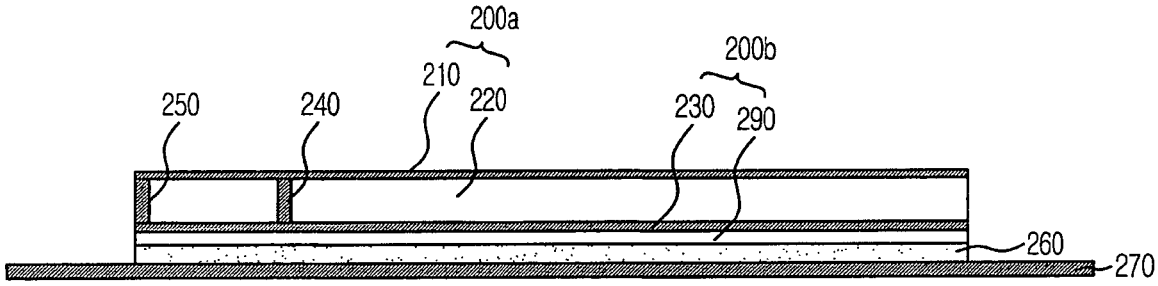
FIG. 8 is a cross-sectional view of the PIFA of FIG. 7.

FIG. 7 is a perspective view of a PIFA in accordance with a second embodiment of the present invention and FIG. 8 is a cross-sectional view of the PIFA shown in FIG. 7. The PIFA of the present invention includes a radiation patch layer 210, a first dielectric layer 220, a CPW feeding layer 230, a feeding probe 240, a short-circuit post 250 and a second dielectric layer 290.

The second embodiment further includes the second dielectric layer 290 in comparison with the first embodiment. The radiation patch layer 210 is formed by etching a conductive layer of a first PCB substrate 200*a* including the first dielectric layer 220 and a conductive layer. The CPW feeding layer 230 is formed by etching a conductive layer of a second PCB substrate 200*b* including the second dielectric layer 290 and a conductive layer. Since structures of the radiation patch layer 210, the CPW feeding layer 230, the feeding probe 240 and the short-circuit post 250 are the same as the structures of the radiation patch layer 110, the CPW feeding layer 130, the feeding probe 140 and the short-circuit post 150 of FIG. 3, detailed description will not be provided herein. A spacing layer 260 electrically separates the PIFA of the present invention from a metal surface 270, to which the PIFA is attached, and is attached to the second dielectric layer 290. Since a structure of the spacing layer 260 is the same as the structure of the spacing layer 160 of FIG. 3, detailed description will not be provided herein.

In case of the first PCB substrate 200*a* having a conductive layer in one side of the first dielectric layer 220, a radiation pattern layer 210 is formed to have a U-type slot by a method of etching on the conductive layer of one side of a first dielectric layer 220 and in case of the second PCB substrate 200*b* having the conductive layer on one side of the second dielectric layer 290, the CPW feeding layer 230 is formed on a conductive layer by performing etching to produce the RFID tag by using the PIFA of FIG. 7. Materials having a low dielectric rate such as Teflon can be used as the dielectric first and second dielectric layers 220 and 290. The CPW feeding layer 230 having the same structure as the CPW feeding layer 130 includes the feeding block of the T shape having the metal pad and the ground surface, which covers the feeding block and is positioned at a predetermined distance from the feeding block. Subsequently, the RFID chip is bonded to the CPW feeding layer 230 by using the conductive ink, and the first PCB substrate 200*a* is attached to the second PCB substrate 200*b* so that the first dielectric layer 220 can be attached to the CPW feeding layer 230.

Subsequently, the feeding probe 240 and the short-circuit post 250 are, respectively, connected to the metal pad and the ground surface by feeding conductive material to a via hole formed on the first PCB substrate 200*a*. The RFID tag attachable to the metal surface 270 is produced by attaching the spacing layer 260 to the second dielectric layer 290 by using the Styrofoam.

It is apparent to those skilled in the art that the radiation patch layer and the CPW feeding layer can be formed by using the deposition and printing methods on the dielectric object substrate instead of etching the PCB substrate.

The PIFA of the present invention can be miniaturized through the radiation patch layer, in which the U-type slot is formed. Also, the present invention can be applied to a passive RFID tag since it is easy to attach the RFID chip based on the CPW feeding structure. Also, the present invention can perform the impedance matching between the antenna and the RFID chip by controlling a position of the CPW feeding layer, to which the RFID chip is attached.

Since the RFID tag comes into contact with a metal surface through the spacing layer attached to the antenna in spite of a metal structure environment where an electromagnetic wave environment is very unstable, the present invention can improve communication performance between the RFID reader and the RFID tag. The present invention can easily control the resonant frequency and the reactance of the antenna. Since the present invention can be realized by using the PCB substrate, it is easy to produce the PIFA of the present invention, and production errors and production cost can be reduced when the PIFAs are produced in mass.

The present application contains subject matter related to Korean patent application Nos. 2004-0103081 and 2005-035741 filed with the Korean Intellectual Property Office on Dec. 8, 2004, and Apr. 28, 2005, respectively, the entire contents of which are incorporated herein by reference.

While the present invention has been described with respect to certain preferred embodiments, it will be apparent to those skilled in the art that various changes and modifications may be made without departing from the scope of the invention as defined in the following claims.

What is claimed is:

1. A planar inverted-F antenna (PIFA), comprising:

a radiation patch layer which is formed on one side of a dielectric layer; a Co-Planar Waveguide (CPW) feeding layer which includes a feeding means on the other side of the dielectric layer and a ground surface formed at a predetermined distance from the feeding means;

a feeding probe for electrically connecting the radiation patch layer and the feeding means through the dielectric layer and providing a Radio Frequency (RF) signal to be radiated to the radiation patch layer; and a short-circuiting means for short-circuiting the radiation patch layer from the ground surface through the dielectric layer, wherein characteristic impedance of the CPW feeding layer is controlled based on an interval between the feeding means and the ground surface.

2. The PIFA as recited in claim 1, wherein a U-type slot is formed on the radiation patch layer.

3. The PIFA as recited in claim 2, wherein stubs for controlling antenna current are formed in the U-type slot.

4. The PIFA as recited in claim 3, wherein the stubs are symmetrically formed.

5. The PIFA as recited in claim 1, wherein the feeding means is formed in a T shape.

6. The PIFA as recited in claim 1, wherein the feeding means has a metal pad, and capacitive reactance between the feeding means and the radiation patch layer is controlled based on an area of the metal pad.

7. The PIFA as recited in claim 6, wherein the feeding probe is connected to the metal pad.

8. The PIFA as recited in claim 1, wherein the short-circuiting means includes a plurality of short-circuit posts.

9. The PIFA as recited in claim 8, wherein a resonant frequency of the antenna is controlled based on the number of the short-circuit posts.

10. The PIFA as recited in claim 9, wherein the larger the number of the short-circuit posts is, the higher the resonant frequency is.

11. The PIFA as recited in claim 8, wherein the resonant frequency of the antenna is controlled based on a distance among the short-circuit posts.

12. The PIFA as recited in claim 11, wherein the longer the distance among the short-circuit posts is, the higher the resonant frequency is.

13. The PIFA as recited in claim 1, wherein the longer the distance between the feeding means and the ground surface is, the smaller the characteristic impedance is.

14. The PIFA as recited in claim 1, further comprising:

a spacing layer for separating the antenna from a metal surface by being attached to the CPW feeding layer.

15. The PIFA as recited in claim 14, wherein the spacing layer is formed of a foam material.

16. A planar inverted-F antenna (PIFA), comprising:

a radiation patch layer which is formed on one side of a first dielectric layer;

a Co-Planar Waveguide (CPW) feeding layer which comes in contact with the other side of the first dielectric layer, and includes a feeding means formed on one side of the second dielectric layer and a ground surface formed at a predetermined distance from the feeding means;

a feeding probe for electrically connecting the radiation patch layer and the feeding means through the first dielectric layer and providing a Radio Frequency (RF) signal to be radiated to the radiation patch layer; and a short-circuiting means for short-circuiting the radiation patch layer from the ground surface through the first dielectric layer.

17. A Radio Frequency Identification (RFID) tag, comprising:

a planar inverted-F antenna (PIFA); and an RFID chip connected to the PIFA, wherein the PIFA includes:

a radiation patch layer formed on one side of a dielectric layer; a Co-Planar Waveguide (CPW) feeding layer which includes a feeding means on the other side of the dielectric layer and a ground surface formed at a predetermined distance from the feeding means;

a feeding probe for electrically connecting the radiation patch layer and the feeding means through the dielectric layer and providing a Radio Frequency (RF) signal to be radiated to the radiation patch layer; and a short-circuiting means for short-circuiting the radiation patch layer and the ground surface through the dielectric layer, and wherein the RFID chip is connected to the CPW feeding layer.

18. The RFID tag as recited in claim 17, further comprising:

a spacing layer for separating the antenna and the RFID chip from a metal surface.

19. The RFID tag as recited in claim 17, wherein a U-type slot having an antenna current controlling stub is formed on the radiation patch layer.

20. The RHD tag as recited in claim 17, wherein the feeding means has a metal pad, and capacitive reactance between the feeding means and the radiation patch layer is controlled based on an area of the metal pad.

21. The RFID tag as recited in claim 17, wherein the feeding probe is connected to the metal pad and the short-circuiting means has a plurality of short-circuit posts.

22. The RHD tag as recited in claim 17, wherein characteristic impedance of the CPW feeding layer is controlled based on a distance between the feeding means and the ground surface.

23. A Radio Frequency Identification (RFID) tag, comprising:

a planar inverted-F antenna (PIFA); and an RFID chip which is connected to the PIFA, wherein the PIFA includes:

a radiation patch layer which is formed on one side of a first dielectric layer;

a Co-Planar Waveguide (CPW) feeding layer which comes into contact with the other side of the first dielectric layer, and includes a feeding means formed on one side of a second dielectric layer and a ground surface at a predetermined distance from the feeding means;

a feeding probe for electrically connecting the radiation patch layer and the feeding means through the first dielectric layer and providing a Radio Frequency (RF) signal to be radiated to the radiation patch layer; and a short-circuiting means for short-circuiting the radiation patch layer and the ground surface through the first dielectric layer, and wherein the RFID chip is connected to the CPW feeding layer.

24. The RFID tag as recited in claim 23, further comprising:

a spacing layer for separating the antenna from a metal surface by being attached to the other side of the second dielectric layer.

* * * * *